US011840852B1

(12) United States Patent
Toca et al.

(10) Patent No.: US 11,840,852 B1
(45) Date of Patent: Dec. 12, 2023

(54) TILE-SETTING LIPPAGE CONTROL

(71) Applicant: DTM INNOVATIONS LLC, Metairie, LA (US)

(72) Inventors: Roland Toca, New Orleans, LA (US); Michele Volponi, Metairie, LA (US); Darrin Godbold, Metairie, LA (US)

(73) Assignee: DTM INNOVATIONS LLC, Metairie, LA (US)

( * ) Notice: Subject to any disclaimer, the term of this patent is extended or adjusted under 35 U.S.C. 154(b) by 0 days.

(21) Appl. No.: 17/824,761

(22) Filed: May 25, 2022

(51) Int. Cl.
*E04F 21/00* (2006.01)

(52) U.S. Cl.
CPC ..... *E04F 21/0092* (2013.01)

(58) Field of Classification Search
CPC ..... E04F 21/1877; E04F 21/0092
See application file for complete search history.

(56) References Cited

U.S. PATENT DOCUMENTS 7,861,487 B2 1/2011 Kufner et al.
7,992,354 B2 8/2011 Doda, Jr.
(Continued)

FOREIGN PATENT DOCUMENTS

EP 2549030 A2 11/2014
ES 2927004 T3 * 10/2022 ..... E04F 21/0092
(Continued)

OTHER PUBLICATIONS

Rubi, "New Delta Level System," https://www.rubi.com/en/blog/new-delta-level-system-small-improvements-that-make-a-good-product-great/ (last accessed May 25, 2022).
(Continued)

*Primary Examiner* — Babajide A Demuren
(74) *Attorney, Agent, or Firm* — KEATY LAW FIRM LLC

(57) ABSTRACT

A tile-setting lippage control system and method for tiles set with mortar as floors or walls on prepared surfaces, providing tab-and-wedge pairs with a footed tab having a footplate, a wedge slot having a membrane, a multi-tapered descending portion having a thicker center, tapering base, and tapering sides, and a ridged upper portion having a reinforced upper edge, and with a tensioning wedge having a leading end, wedge bottom, tapered top edge, and wedge teeth. In use, the wedge bottom and the footplate apply a constant compressive force to two adjacent pieces of tile. The size, shape, and location of the wedge slot with the tapered top edge of the tensioning wedge accommodate a range of tile thicknesses by insertion of the tensioning wedge to different depths. Optionally, flap cuts in the ridged upper portion provide for formation of a top flap and side flaps which lock in engagement with the wedge teeth of the tensioning wedge. Optionally, a wedge void in the tensioning wedge provides for easier insertion and for accommodating excess pressure. The multi-tapered descending portion prevents pinching of the footed tab between tiles and prevents trapping of the footed tab by cured mortar. The straight sides of the reinforced upper edges adapt to being struck from a range of angles, and the tapering sides of the multi-tapered descending portion facilitate the tapering base tearing away from the footplate without being blocked by cured mortar around the footplate.

14 Claims, 10 Drawing Sheets

(56) References Cited

U.S. PATENT DOCUMENTS

| | | | | |
|---|---|---|---|---|
| 8,079,199 | B1 | 12/2011 | Kufner et al. | |
| 8,181,420 | B2 | 5/2012 | Torrents I Comas | |
| 8,429,878 | B1 | 4/2013 | Hoffman et al. | |
| 8,689,522 | B2 | 4/2014 | Hoffman et al. | |
| 8,820,031 | B2 | 9/2014 | Kufner et al. | |
| 8,966,835 | B1 | 3/2015 | Hoffman et al. | |
| 9,027,308 | B2 | 5/2015 | Kufner et al. | |
| 9,279,259 | B1 | 3/2016 | Russo | |
| 9,470,002 | B2 | 10/2016 | Irvine et al. | |
| 9,482,019 | B2 | 11/2016 | Fontana | |
| 9,657,485 | B2 | 5/2017 | Meyers | |
| 10,465,394 | B2 | 11/2019 | Sighinolfi | |
| 10,577,813 | B2 | 3/2020 | Dahill | |
| 10,604,945 | B2 | 3/2020 | Volponi et al. | |
| 10,704,275 | B2 | 7/2020 | Bunch et al. | |
| 10,724,254 | B1 | 7/2020 | Troxell | |
| 10,822,813 | B1 | 11/2020 | Bunch et al. | |
| 11,105,102 | B2 | 8/2021 | Bunch et al. | |
| 2015/0308130 | A1* | 10/2015 | Biec | E04F 21/0092 52/749.11 |
| 2018/0291640 | A1* | 10/2018 | Sighinolfi | E04F 21/0092 |
| 2018/0355623 | A1 | 12/2018 | Frisco | |
| 2019/0093372 | A1* | 3/2019 | Russo | E04F 21/20 |
| 2019/0169863 | A1* | 6/2019 | Torrents Comas | E04F 21/1877 |
| 2020/0347617 | A1* | 11/2020 | Troxell | E04F 21/0092 |
| 2021/0062522 | A1* | 3/2021 | Castellanos | E04F 21/0092 |
| 2021/0131124 | A1* | 5/2021 | Bunch | E04F 13/0892 |

FOREIGN PATENT DOCUMENTS

| | | | | |
|---|---|---|---|---|
| ES | 2932835 | T3 * | 1/2023 | E04F 15/02022 |
| WO | WO2018052331 | A1 | 3/2018 | |

OTHER PUBLICATIONS

MLT Mechanical Lippage Tuning System, https://www.mltsystem.it/en/ (last accessed May 25, 2022).

YouTube, "Spin Doctor Tile Leveling System: Wall & Floor Installation," https://www.youtube.com/watch?v=NwP1OW1-7L0 (last accessed May 25, 2022).

YouTube, "QEP's LASH Tile Leveling System | The Home Depot," https://www.youtube.com/watch?v=PUBAnbAm3AI (last accessed May 25, 2022).

YouTube, "Tuscan SeamClip Tile Leveling System by Pearl," https://www.youtube.com/watch?v=J -_Ngy8AyxE (last accessed May 25, 2022).

YouTube, "How to use Tile Leveling Clips by Peygran," https://www.youtube.com/watch?v=k9OkRgIqSZI (last accessed May 25, 2022).

* cited by examiner

TILE-SETTING LIPPAGE CONTROL

BACKGROUND OF THE INVENTION

This invention provides a tile-setting lippage control system and method for tiles set with mortar as floors or walls on prepared surfaces.

When setting tiles such as gauged porcelain tiles, panels, or slabs, or the equivalent stones or slate, lippage, or the variations in the level of the tops of the edges of the tiles after installation, is a problem of great concern. Variations of lippage or level can be visually unacceptable, as with shadows cast on walls having strong downward, upward, or side lighting. Variation of lippage or level on floors can be dangerous as tripping hazards and as areas prone to further damage by striking raised edges.

Tile installations are tending toward larger tiles and smaller grout lines, both of which can compound lippage problems. The ANSI A108.19 standard for tile installation requires a lippage control system where any dimension of the tiles is one meter or greater. The maximum allowable lippage is 1/32 inch.

Lippage control devices place compressive force on the top edges and bottom edges of adjacent tiles and force the top edges to align while accommodating variations in thickness at the bottom edges. The bottom surfaces of the tiles, including at the edges and including any lippage control device underneath the tiles, must be covered with and supported by mortar. Lippage control devices necessarily extend through the grout joint between adjacent tiles.

After the mortar has set, any parts of the lippage control device which extends up through the grout joint to the top surface of the tiles must be removed. It is undesirable to leave any scraps from the device in the grout joint, and unacceptable to leave any scraps at or near the surface of the grout. A common method for removing such parts of the lippage control device after the tiles are set is to laterally strike the parts. The striking can be done with a tool, such as a non-marking rubber mallet, but is often done with the more readily available work boot. This removal method carries a great risk of damage to the installed tile, which will frequently require cumbersome and expensive removal of damaged tile and replacement with an exactly matching tile. Many present lippage control devices either possess design features which allow the parts to become pinched or bound or blocked within the grout joint, making removal difficult and increasing the chance of damage, or features which require more cumbersome removal procedures than simply striking, sometimes requiring special tools and significant time spent on each removal.

The ANSI A108.19 standard requires that any lower part of any lippage control device which remains underneath the tiles after installation should be encapsulated with mortar. This encapsulation with mortar builds up mortar at the base of any lippage control device, and that mortar, when cured and set, can bind or block the lower parts of the device and interfere with clean removal without damage.

The smallest or thinnest grout joint allowed by the ANSI standard is 1/16" or 0.8 mm. Such a thin grout line is used in many installations. Presently known lippage control devices which have a thickness or depth in excess of 1/16" prevent installations having thinner grout lines. Although presently known lippage control devices are not necessarily designed to be used as spacers, they are often used as spacers anyway, and are likely to become pinched or bound between the tile edges, requiring excessive force, digging, or cutting to remove, increasing likelihood of damage to the installed tiles.

U.S. Pat. No. 8,966,835 for a "Reusable Shim Shell Mechanical Edge Setting System and Method for Setting Tiles and Tuning Lippage," issued on Mar. 3, 2015 to assignee New Standards Manufacturing Co., provides for a tile aligning and lippage tuning system that uses an under tile base interstitial strap, which is connected to said under tile base, and a shim shell cap configured to slip over the connecting tab. The system also comprises of a bottom tile mating shim and a top shim.

U.S. Pat. No. 9,482,019 for a "Leveling Device for Laying Tiles or the Like," issued on Nov. 1, 2016 to assignee PROFILITEC S.P.A. SOCIO UNICO, provides for a leveling device for laying tiles, or the like, which includes a tie-rod having a support base for edge portions of one or more adjacent tiles, a projecting element from the base, which can be arranged into junctions between adjacent tiles, and a knob coupling with the projecting element and having an outlet pass-through hole for a free end of the projecting element. The knob is configured to force an edge portion of the adjacent tiles against the base to level the placement and is configured to receive and retain, by snap coupling elements, a blocking tie-rod hooking and retaining the projecting element inside a pass-through channel defined in the blocking tie-rod. The blocking tie-rod is sectioned into two coupling half-shells, embracing and constraining the projecting element when inserted in the cap, and mutually separating to leave free the projecting element when at least partially extracted from the cap.

International Publication No. 2018/052331 for a "Tile-Levelling System," published on Mar. 22, 2018 by inventor Aleksandar Jelíc, discloses a tile levelling system that enables the tiling of floors, walls, and ceilings so that the resulting surface is completely flat and lippage free. The system comprises a base plate with a vertical member, which has a rectangular opening perpendicular to the base plate, and two opposite longitudinal grooves, which are V-shaped in cross section, placed below the rectangular opening on the vertical member. The upper surface of the base plate is flat. The lower surface of the base plate is corrugated with parallel ridges. Between these ridges are grooves, which ensure better adhesion of either adhesive or aggregate to the very base plate, thus making the entire construction stronger.

European Patent No. 2 549 030 for a "A Device for Correct Laying of Floor Tiles," issued on Nov. 12, 2014 to assignee Brunoplast di Eleuteri Bruno, provides for a plastic device for correct laying of floor tiles, and the device comprises of a base from which a vertical blade centrally protrudes, supporting a threaded stem in upper position and being connected on the bottom with said base by means of a lower end with thinned section suitable to act as tearing line. The device also comprises of a knob, consisting in a cylindrical cover, starting from its upper closing wall, with a central cylindrical conduit with internal threaded walls, adapted to exactly receive, by means of a helical coupling, said threaded stem provided in upper position on said base.

U.S. Pat. No. 8,181,420 for a "Levelling Device for the Placing of Pieces for Covering Floors and Similar," issued on May 22, 2012 to assignee Germans Boada, S.A., provides for a device that has a first lower substantially flat body, which has in its upper part a flexible post with a narrowed or weakened portion and a second upper body with the passage for receiving and securing said post. The flexible post, which has a rectangular cross section, has in its main surfaces respective mutually opposed "teeth" which are offset in the lengthwise direction and the passage of the second body has two latching pawls mutually opposed, so that in the operative position of the devices, the teeth of the flexible post engage in an alternate form with said latching pawls. The second body has a bell like hollow form with a lower widened contact mouth or border.

U.S. Pat. No. 8,079,199 for a "Tile Alignment and Leveling Device," issued on Dec. 20, 2011 to assignee Davinci Italia/USA Group, LLC, provides for a device for aligning and leveling tiles as they are laid in floors, walls, countertops, or the like. The device has a locking assembly and a bottom plate. The components are combined with a shaft that extends from the bottom plate through the locking assembly so that the locking assembly is movable along the length of the shaft. In use, the device is placed between adjacent tiles so that the locking assembly and bottom plate hold adjacent tiles at a desired height as the setting bed dries.

U.S. Pat. No. 9,657,485 for a "Tile Leveling System," issued on May 23, 2017 to inventor Lawrence G. Meyers, provides for a tile leveling system that includes an anchor member arranged to be positioned in a setting bed below adjacent tiles. A tensioning member extends upwardly from the anchor member and is arranged to pass between the adjacent tiles. The tensioning member is made of a metallic material and frangibly connected to the anchor member via a breakage point. A loading system is arranged to be positioned on top of the adjacent tiles and includes a drive mechanism. The drive mechanism is connected to the tensioning member and is selectively operable to secure and level the adjacent tiles between the anchor member and the loading system.

U.S. Pat. No. 9,279,259 for a "Tile Lippage Removal System," issued on Mar. 8, 2016 to inventor William P. Russo, provides for a tile lippage removal system that includes a spacer post, a threaded cap, and an anti-friction protection plate. The spacer post includes a base member, a spacer member, and a threaded shaft. A bottom of the spacer member extends from a top of the base member. A break away connection is made between the spacer member and the base member. A bottom of the threaded shaft extends from a top of the spacer member. A plurality of grip extensions extends from an outer surface of a substantial inverted cup to allow rotation of the threaded cap. A female thread is formed in a center of the substantial inverted cup to threadably receive the threaded shaft. The anti-friction protection plate includes a round outer perimeter and a spacer opening, which is sized to receive the spacer member. The anti-friction protection plate may be used to improve existing tile lippage removal systems.

U.S. Pat. No. 9,470,002 for a "Tile Leveller and Spacing System," issued on Oct. 18, 2016 to assignee ME INNOVATIONS PTY LTD, provides for a tile leveller and spacer system that allows rapid and reliable spacing and levelling of tiles. The tile spacer comprises a base for locating the spacer under the tiles, and a stem that includes an alignment cross which is used to correctly space the tiles. The stem tile spacer is placed over the stem and engages with teeth on the stem. The tile leveller is pushed down over the stem to level the tiles between the base and the bottom of the tile leveller. The stem further comprises a frangible portion located between the base and the tile alignment portion, and when the stem is pulled with sufficient force, the frangible portion breaks to allow removal of the stem. A hand tool may be used to assist in this process. The hand tool can have an adjustable stop which can be set to a first setting to level the tiles, and a second setting to cause the frangible portion to break, allowing removal of the stem and leveller.

US Publication No. 2018/0355623 for a "Tile Leveling System," published on Dec. 13, 2018 by inventor Scott Frisco, discloses a tile leveling system for leveling tiles. The system has a tile lifter whose transverse member is inserted into the grout gap, and turned to get underneath adjacent tiles. The system has a reusable clamping unit, a U-shaped, possibly flexible, wedge, which is slid through the lifter's vertical shaft to sandwich the tiles between the transverse member and the wedge. The transverse member can be concave up, and the lifter can have two transverse members with spacers on each four-corner junction. The lifter's handle can have a U-shaped hole, which allows a rocker tool to be used to level tiles. Another leveling tool, called a gun tool can be used with any of the lifters. Also proposed are two simpler threaded and zip-tie systems. The leveling devices can be used as needed, thus saving the cost of using them in the entire tiled area.

U.S. Pat. No. 8,429,878 for a "System and Method for Aligning and Leveling Tile," issued on Apr. 30, 2013 to assignee New Standards Manufacturing Co., provides for a tile aligning and leveling system that uses an under tile base, a re-usable upright connecting tab, which is detachably connected to said under tile base, a re-usable flexible edge slotted cap configured to slip over the connecting tab and latch thereto as the cap is slid further down the connecting tab. The cap has an edge slot so that the connecting tab can be separated from the cap, by merely sliding the cap, so that the connecting tab passes through the slot. A flexible spring-like portion of the cap provides increased force on the tile even if undesired elongation of the connecting tab occurs.

U.S. Pat. No. 8,820,031 for a "Tile Alignment and Leveling Device," issued on Sep. 2, 2014 to assignee Davinci Italia/USA Group, LLC, provides for a tile alignment and leveling device for aligning and leveling tiles as they are being secured to a substrate. The device includes a flexible member, a bottom plate, and an intermediate member. The intermediate member spaces the flexible member and bottom plate a predetermined vertical distance. The flexible member has a first end and a second end. The first end is pivotally combined with the intermediate member thereby allowing the flexible member to pivot between a first position and a second (downward) position. In use and in its second position, the flexible member second end exerts force against the top of the tiles to help align and level the tiles as they are secured to the substrate.

SUMMARY OF THE INVENTION

This invention provides a tile-setting lippage control system and method for use with tiles set with mortar as floors or walls on prepared surfaces.

The tile-setting lippage control system provides tab-and-wedge pairs with a footed tab having a footplate, a wedge slot having a membrane, a multi-tapered descending portion having a thicker center, a tapering base, and tapering sides, and a ridged upper portion having a reinforced upper edge, and with a tensioning wedge having a leading end, a flat wedge bottom, a tapered top edge, and wedge teeth.

In use, the wedge bottom and the footplate apply a constant compressive force to two adjacent pieces of tile. The size and location of the wedge slot with the tapered top edge of the tensioning wedge accommodate a range of tile thicknesses by insertion of the tensioning wedge to different depths. The multi-tapered descending portion prevents pinching of the footed tab between tiles and prevents trapping of the footed tab by cured mortar. The straight sides of the reinforced upper edges adapt to being struck from a range of angles, and the tapering sides of the multi-tapered descending portion facilitate the tapering base tearing away from the footplate without being blocked by cured mortar around the footplate.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
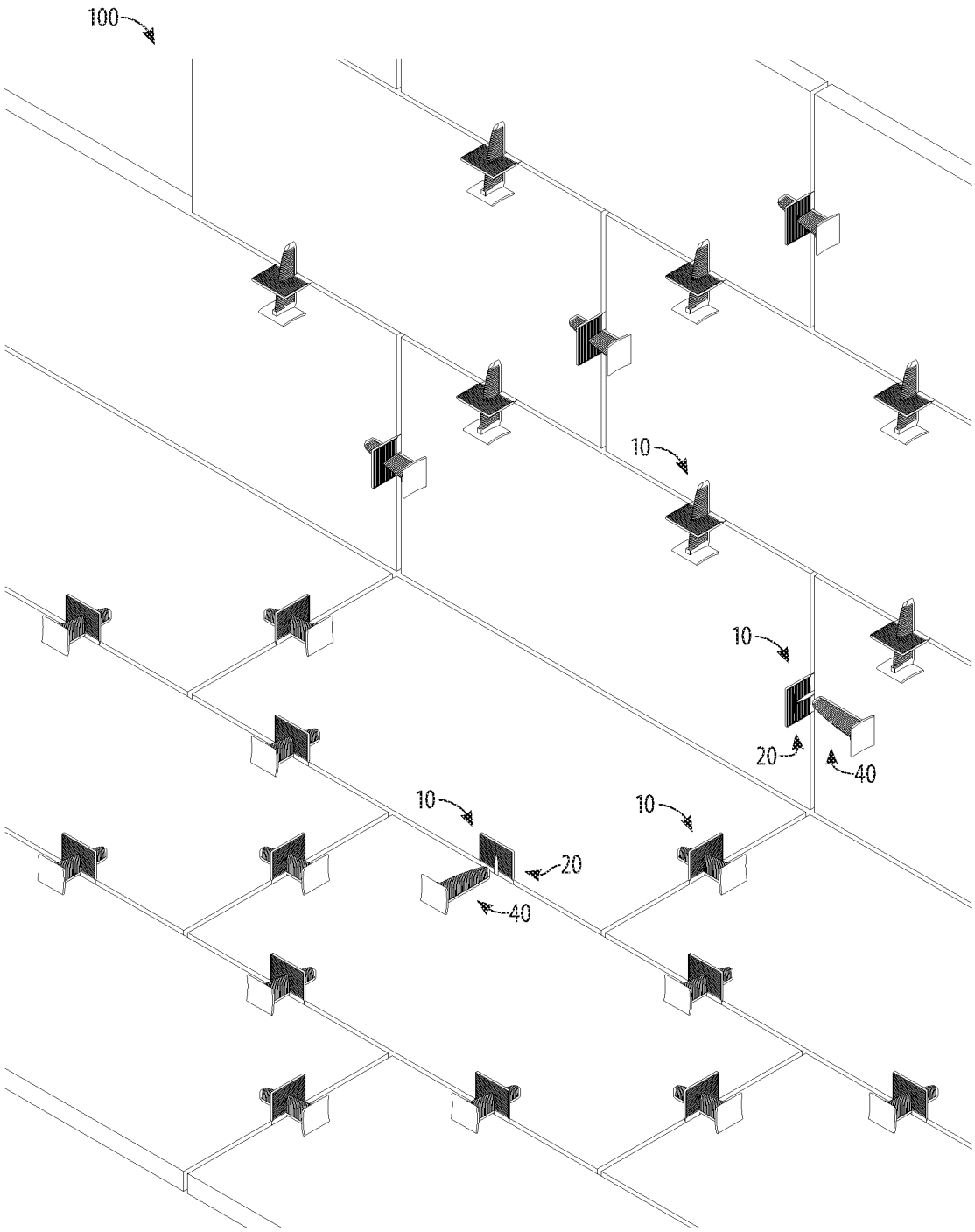
FIG. 1 is a schematic view of the tile-setting lippage control system and method of the invention in use on tile set on a horizontal and a vertical surface.

Referring to FIG. 1, the tile-setting lippage control system and method 100 for use with tiles set with mortar as floors or walls on prepared surfaces provides tab-and-wedge pairs 10 in turn providing footed tabs 20 and tensioning wedges 40. Usually, gauged tiles or panels or slabs are used and are set with thinset mortar. Usually, a very thin grout line is used, with 1/16" or 0.8 mm being the thinnest allowed by ANSI A108.19.

Figure 2:
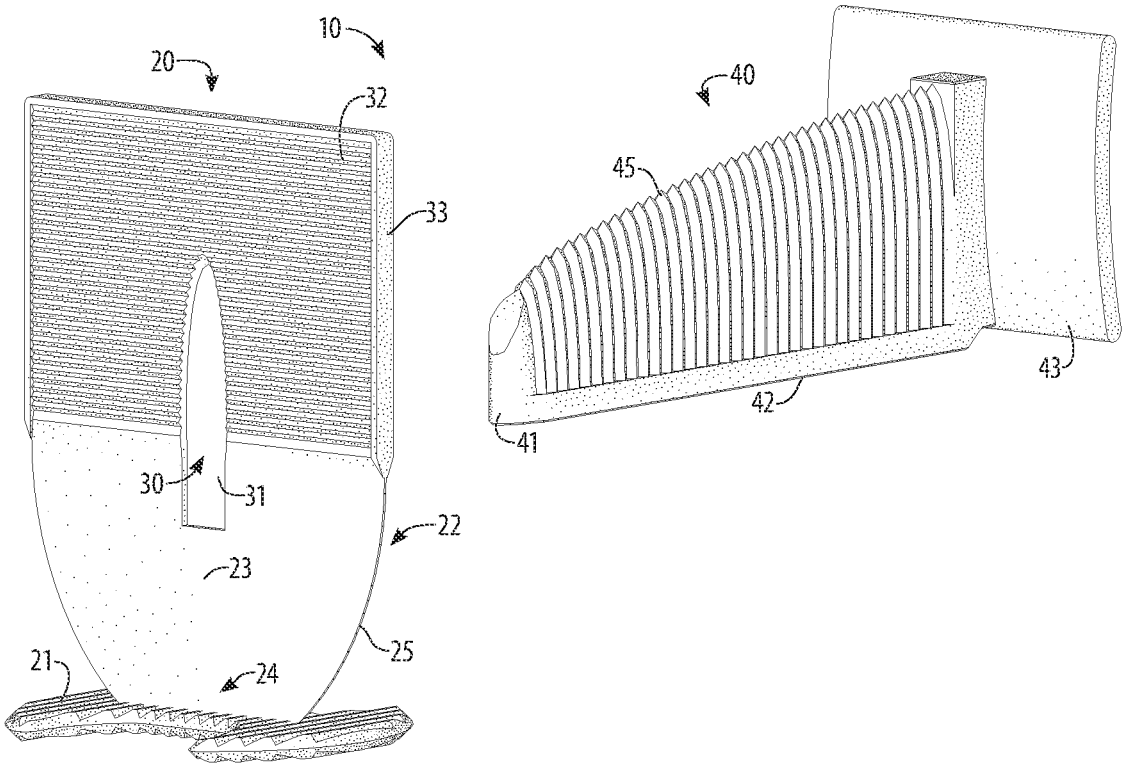
FIG. 2 is a perspective view of the tab-and-wedge pair of an embodiment of the tile-setting lippage control system of the invention.

Referring to FIG. 2, the footed tab 20 has a top-to-bottom orientation in relation to the tiles to be set, with a footplate 21 at the bottom, meant to fit underneath the bottoms of the tiles, and with a top portion extending above the top surfaces of the tiles, with sides extending along the grout line where the tiles join, and with tab faces substantially parallel to the tile edges, with one face toward one tile and the other face toward the other tile. For horizontal setting of tiles on a floor, the top-to-bottom orientation corresponds to normal up and down directions. For vertical or angled setting of tiles on a wall or other non-horizontal prepared surface, the top-to-bottom orientation corresponds to a line perpendicular to that non-horizontal surface.

Figure 3:
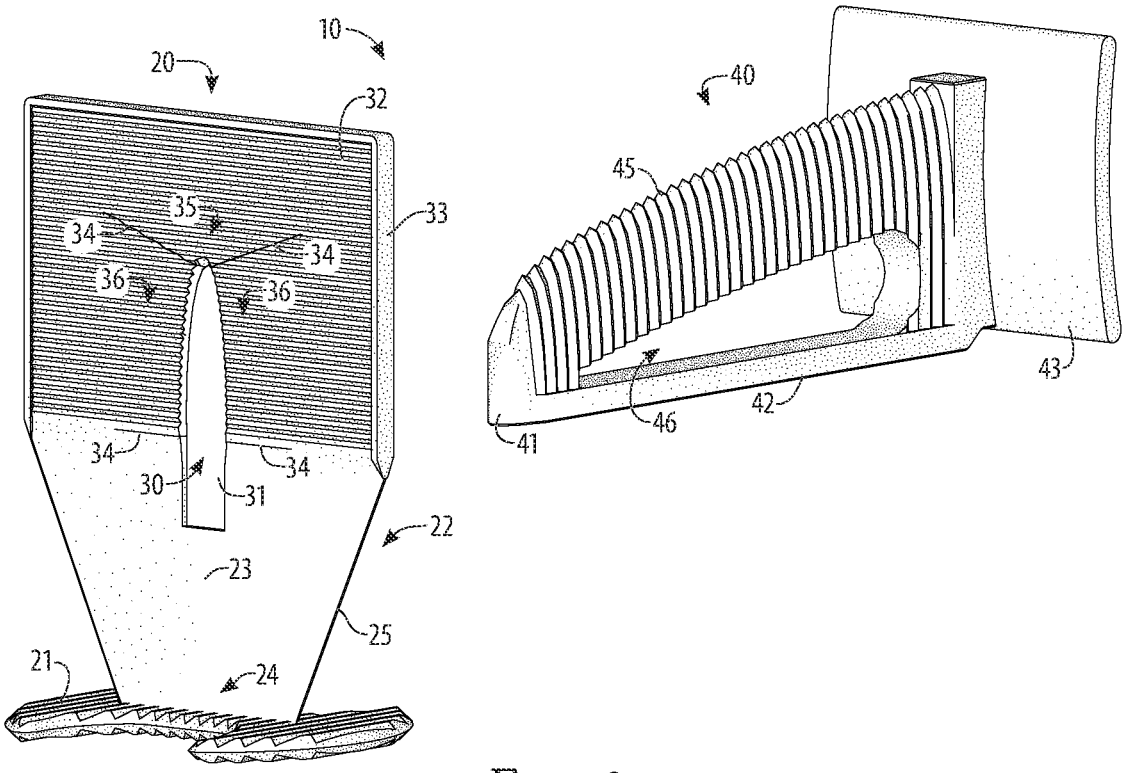
FIG. 3 is a perspective view of the tab-and-wedge pair of another embodiment of the tile-setting lippage control system of the invention.

Referring additionally to FIG. 3, embodiments of the tile-setting lippage control system 10 can also provide a wedge void 46, and flap cuts 34 for the formation of a top flap 35 and side flaps 36, as treated in detail below.

The footed tab 20 can be made of plastic material, including recycled plastic material. High-density polyethylene (HDPE) is a suitable material.

The footplate 21 is mounted at the bottom of the footed tab 20. The footplate 21 has a double-forked footprint to allow for areas of direct mortar joining of the bottom of the tiles to the prepared surface, encapsulating the footplate 21. The footplate 21 also has a large number of ridges to allow the flow of mortar and further encapsulation of the footplate 21 by the mortar, further avoiding voids in the mortar at the footed tab 20, ensuring a stable setting and preventing later damage to the tiles at the site of the footplate 21, which remains underneath the tiles after the tiles are set.

Figure 6:
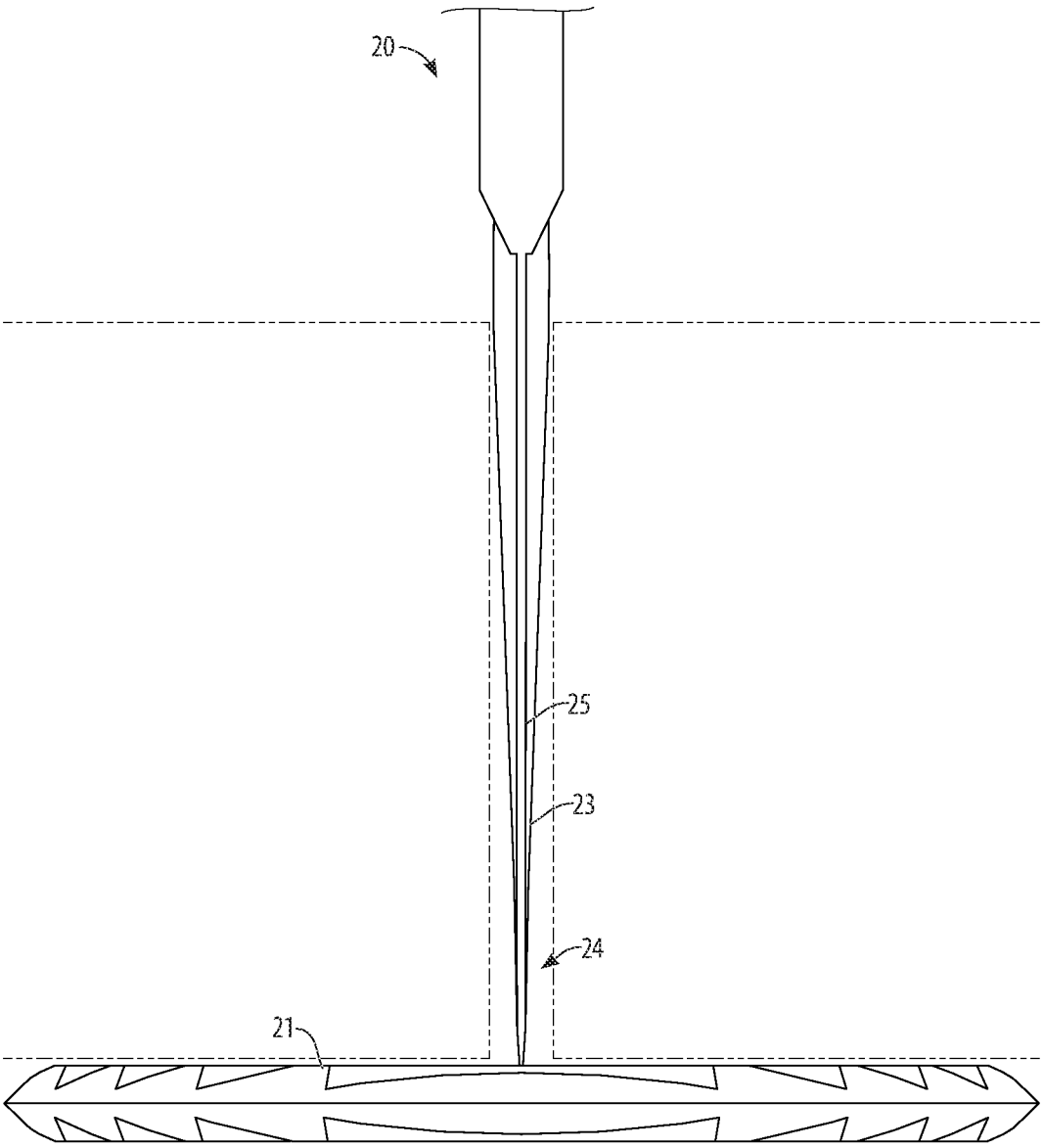
FIG. 6 is a side view of the footed tab of the tile-setting lippage control system of the invention in use between two tiles.

Referring briefly to FIG. 6, the multi-tapered descending portion 22 of the footed tab 20 extends in use from substantially just above the level of the thickest tiles anticipated, down through the grout joint to the footplate 21. A thicker center 23 is provided, where the thickness or depth of the multi-tapered descending portion 22 is at a maximum, with thinning toward the sides. The multi-tapered descending portion 22 tapers in width from widest at the upper extreme to narrowest at the lowest extreme. The multi-tapered descending portion 22 also tapers in depth or thickness from a maximum thickness at the thicker center 23 down to a minimum depth or thickness at the edge of each tapering side 25. The multi-tapered descending portion 22 also tapers in depth or thickness in the tapering base 24 portion from a greater thickness at the upper portion to a minimum thickness at the lowest portion where the tapering base 24 portion is joined to the footplate 21.

When the footed tab 20 is used as a spacer in addition to its use for lippage control, the thicker center 23 sets the spacing, while the thinning toward the edges prevents the tile edges from exerting a pinching force on the entire multi-tapered descending portion 22. The tapering of the multi-tapered descending portion 22 leaves a significant amount of void space in the grout joint. The lower portions of that void space can accommodate the mortar required for complete encapsulation of the footplate 21, without causing any binding or blocking obstructing later removal of the footed tab 20.

Also, when the footed tab 20 is used as a spacer, a thickness that is from 1/32 to 1/64 inch thicker than the actual finished size of the grout joint is appropriate. For example, a maximum thickness of 3/32 inch would be used to obtain a true 1/16 inch grout joint.

Even when not used as a spacer, the thicker center 23 with thinning toward the edges and toward the top of the footed tab 20 prevents cured mortar from being trapped within the multi-tapered descending portion 22 and creating an impediment to clean removal. The tapering base 24 of the multi-tapered descending portion 22 thins toward its area of joining with the footplate 21. This thinning prevents cured mortar from being trapped, and also provides a preferred area for later tearing of the footed tab 20 from the footplate 21 during removal.

The tapering sides 25 of the multi-tapered descending portion 22 of the footed tab 20 taper from the full width of the footed tab 20 at a higher level to a reduced width at the bottom where the footplate 21 is joined to the footed tab 20. In a curved-sided embodiment, shown in FIG. 2, the tapering reduction of width is in a curved line. In a straight-sided embodiment, shown in FIG. 4, the tapering reduction of width is in a straight line.

The three-dimensional structure of the multi-tapered descending portion 22 has the property that at any point along the tapering side 25, any adjacent point toward the center will be thicker and therefore stronger, and any adjacent point away from the center will be thinner and therefore weaker. Therefore, if any point toward any edge of the multi-tapered descending portion 22 becomes embedded in cured mortar, the adjacent points toward the center will be thicker and therefore stronger, and also therefore will have occupied the space and prevented any mortar from surrounding and blocking in or trapping the first point. And therefore, when pulling the multi-tapered descending portion 22 out of the cured mortar, at any given point, the adjacent points toward the center will be thicker and stronger and will pull the thinner weaker given point along, and the given point will be pulled into the void space formerly occupied by the thicker adjacent points and not be pulled into any blocking or trapping cured mortar. This ease-of-removal property is enhanced by forming the footed tab 20 from a material with an inherent resistance to bonding to the mortar, such as HDPE, disclosed above.

Figure 4:
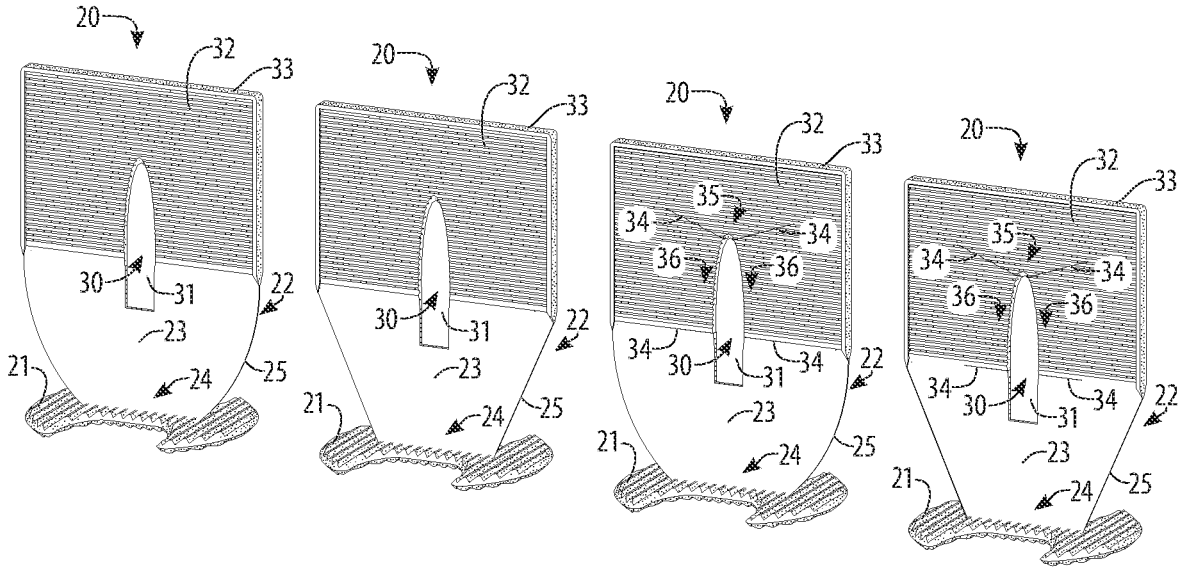
FIG. 4 is a perspective view of embodiments of the footed tab of the tile-setting lippage control system of the invention.

Shown in FIG. 4 are embodiments of the footed tab 20 having either curved or straight tapering sides 25 and having or not having flap cuts 34 for formation of a top flap 35 and side flaps 36 in use, as treated below.

A wedge slot 30 is provided in substantially the middle of the footed tab 20. The size and the top-to-bottom location of the wedge slot 30 is meant to accommodate the tensioning wedge 40 in such a way that various thicknesses of tile can be accommodated by greater or lesser insertion of the tensioning wedge 40, as treated in more detail below. The top of the wedge slot 30 is of a shape substantially of an ogive or ogival arch such as a pointed, peaked, Gothic, or lancet arch. The shape can be an elliptical ogive or close to an elliptical ogive. The top portion of the tensioning wedge 40 is of a corresponding shape, as treated below. The shape provides strength and efficient distribution of force between the footed tab 20 and the tensioning wedge 40.

The wedge slot 30 is initially sealed by a membrane 31. The membrane 31 prevents mortar from spilling through the wedge slot 30, where the mortar, when cured, could form a bridge which would trap or bind the footed tab 20, making removal difficult and increasing the risk of damage to the tiles. In use, the tensioning wedge 40 will puncture and tear an upper portion of the membrane 31 and leave a lower portion of the membrane 31 substantially intact, as treated below.

A ridged upper portion 32 of the footed tab 20 extends above the tile surface in use, and provides a stable structure for the mounting of the tensioning wedge 40, for the exertion of compressive force against the tiles, and for eventual removal of the footed tab 20 by a lateral striking motion. The lateral ridges provide added strength and stability in the lateral direction and also provide a gripping surface to enhance control during installation. The ridged upper portion 32 is surrounded at the top and sides by a reinforced upper edge 33, which provide further strength and stability and further gripping surface. The sides of the reinforced upper edge 33 are straight, and allow for glancing lateral striking during removal, as treated in more detail below. The reinforced upper edge 33 and the lateral ridges provide structural strength where such strength is needed, while allowing the vertical strength and stability of the ridged upper portion 32 to remain at a balanced level which is strong enough to transfer the upward force of the tensioning wedge 40 down to the footplate 21, but weak enough to deform, collapse, or tear if too much force is applied, such as when a tensioning wedge 40 is bumped or kicked too far in, preventing damage to the tiles by absorbing the excess force in the ridged upper portion 32.

In some embodiments, flap cuts 34 in the ridged upper portion 32 provide for the formation of a top flap 35 and side flaps 36 when the tensioning wedge 40 is pushed into the wedge slot 30, as treated in more detail below.

Figure 5:
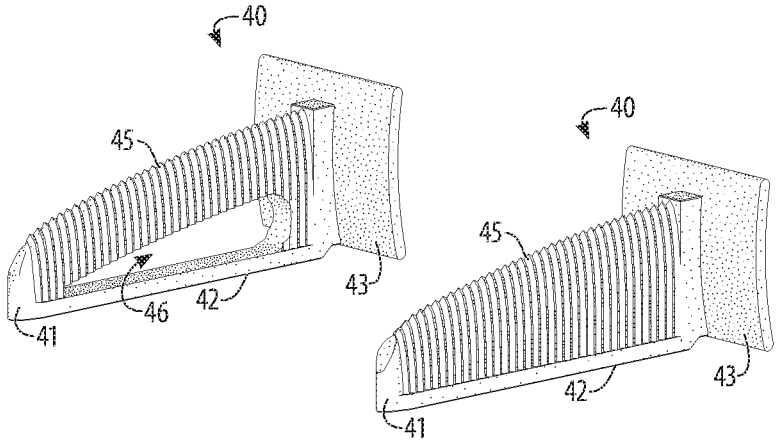
FIG. 5 is a perspective view of embodiments of the tensioning wedge of the tile-setting lippage control system of the invention.

Referring to FIG. 5, the tensioning wedge 40 has a leading end 41 and a wide trailing end 43. The straight wedge bottom 42 exerts compressive force against the top surface of the tiles in use. The top surface of the tensioning wedge 40 has a tapering height increasing from the leading end 41 toward the wide trailing end 43. This top surface contacts and presses against the top of the wedge slot 30 of the footed tab 20 in use. Wedge teeth 45 along the upper and middle portions of the tensioning wedge 40 engage with and lock or toggle against the wedge slot 30 in use, securing the tab-and-wedge pair 10 in place, exerting constant compressive force on the tiles during curing of the mortar. The wide trailing end 43 of the tensioning wedge 40 provides a wide surface for pushing the tensioning wedge 40 into the wedge slot 30 of the footed tab 20, which will usually be done with the user's thumb, and provides a gripping surface for retraction of the tensioning wedge 40 for adjustment or removal. The tensioning wedge 40 is not permanently altered or damaged during normal use, and so it can be re-used for later installations. In embodiments having a wedge void 46, the wedge void 46 is a hole or slot passing through the lower middle portion of the sides of the tensioning wedge 40 providing for deforming slightly during insertion, making insertion easier, but exerting a force resisting that deformation, where that resisting force provides a constant appropriate upward force against the wedge slot 30 of the footed tab 20 during use during the setting of the mortar. The wedge void 46 can also provide some additional protection against damage to the tiles from over-insertion or bumping or kicking of the tensioning wedge 40 by deforming to absorb or at least spread out the duration of the sharp force.

The tensioning wedge 40 can be made of plastic material, including recycled plastic material. High-density polyethylene (HDPE) is a suitable material. Although a tensioning wedge 40 made of a wide variety of plastic materials should not damage or mar the installed tile during normal use, an inherently non-marring material such as HDPE can be beneficial in preventing damage from improper use or accidental pressure, striking, or kicking.

Figure 7:
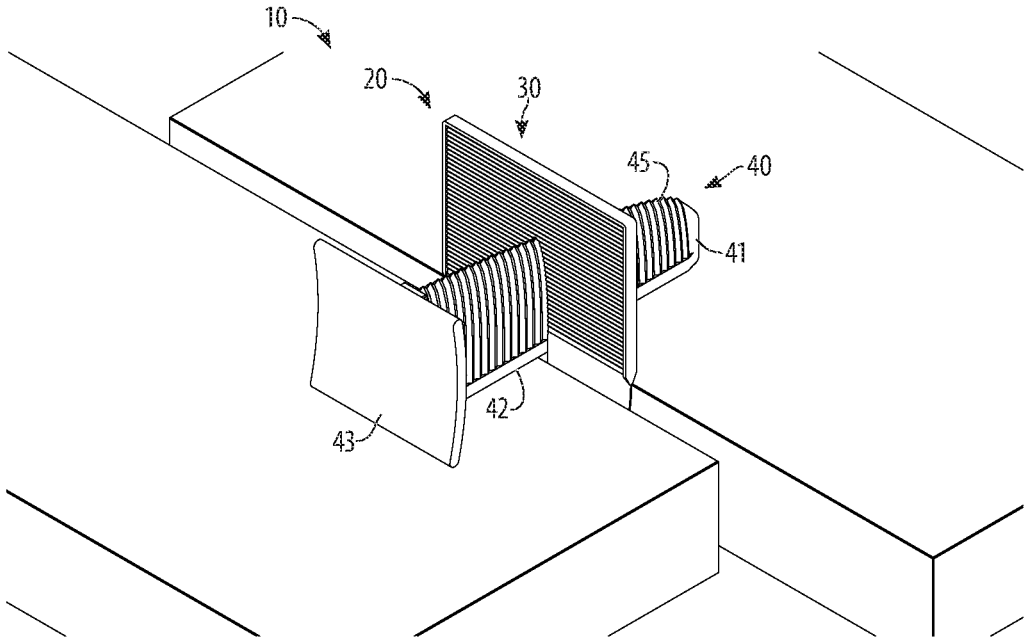
FIG. 7 is a perspective view of the tab-and-wedge pair of the tile-setting lippage control system in use on tile having a medium thickness.
Figure 8:
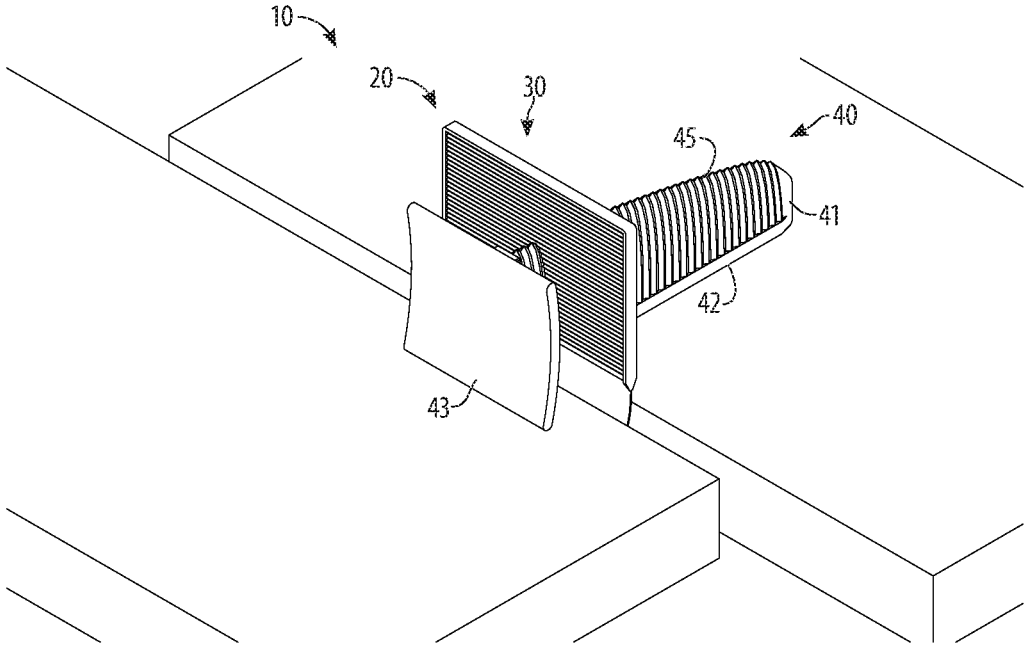
FIG. 8 is a perspective view of the tab-and-wedge pair of the tile-setting lippage control system in use on tile having lesser thickness.

Referring to FIG. 7 and FIG. 8, the tile-setting lippage control system can be used for different installations of different thicknesses of tile. Different thicknesses of tile require different distances of pushing the tensioning wedge 40 into the wedge slot 30. The top surface of the tensioning wedge 40 is tapered, increasing in height from the leading end 41 toward the wide trailing end 43. A smaller thickness of tile will require the tensioning wedge 40 to be pushed in more in order to achieve the desired compressive force on the tops and bottoms of the tile.

Figure 9:
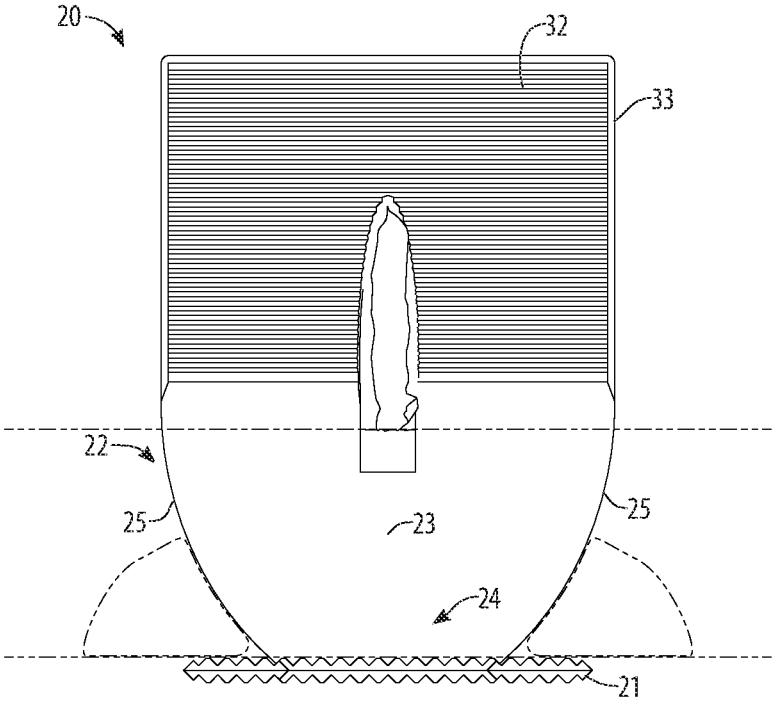
FIG. 9 is a front view of a curved-sided embodiment of the footed tab of the tile-setting lippage control system of the invention in use after curing of mortar and before removal.
Figure 10:
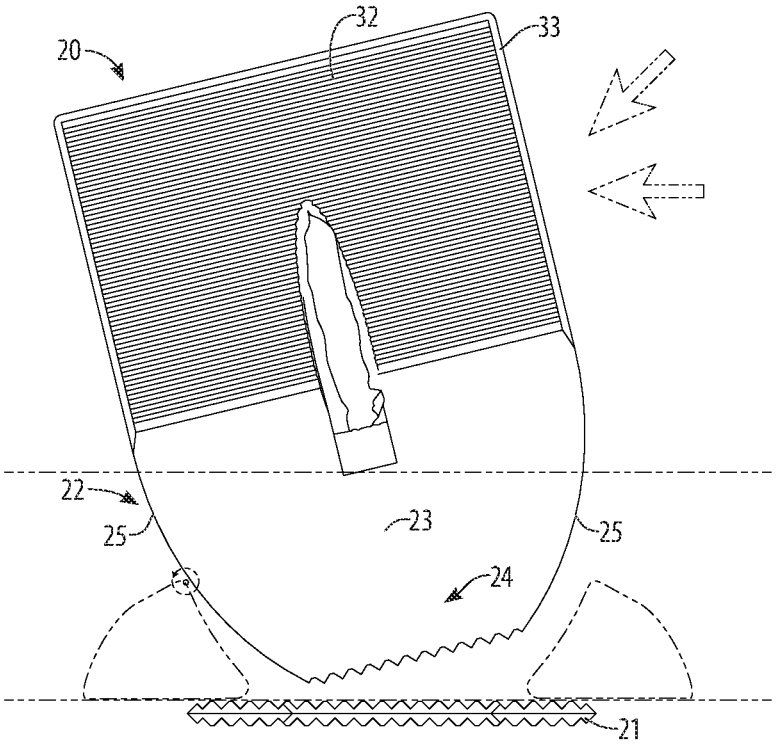
FIG. 10 is a front view of the curved-sided embodiment of the footed tab of the tile-setting lippage control system of the invention in use during removal from cured mortar.
Figure 11:
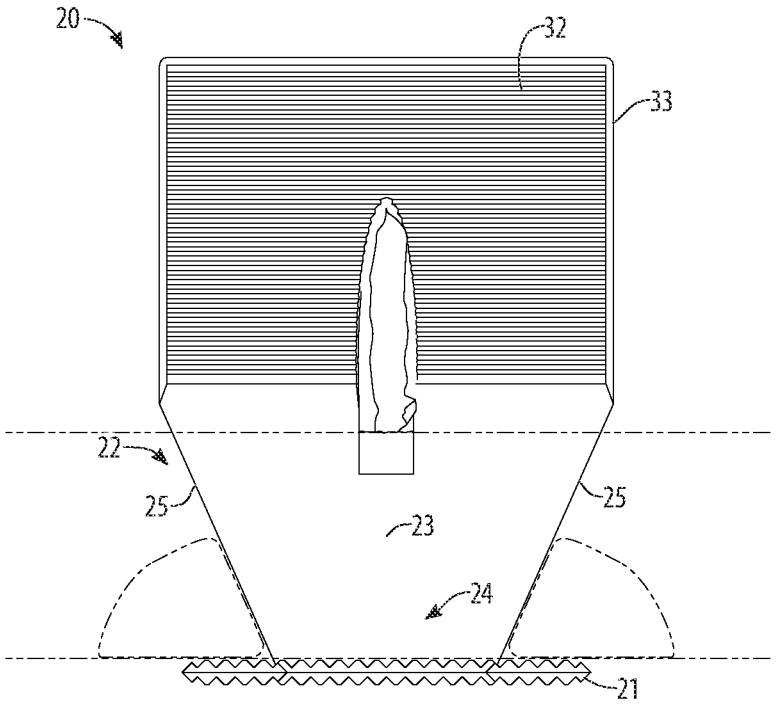
FIG. 11 is a front view of a straight-sided embodiment of the footed tab of the tile-setting lippage control system of the invention in use after curing of mortar and before removal.
Figure 12:
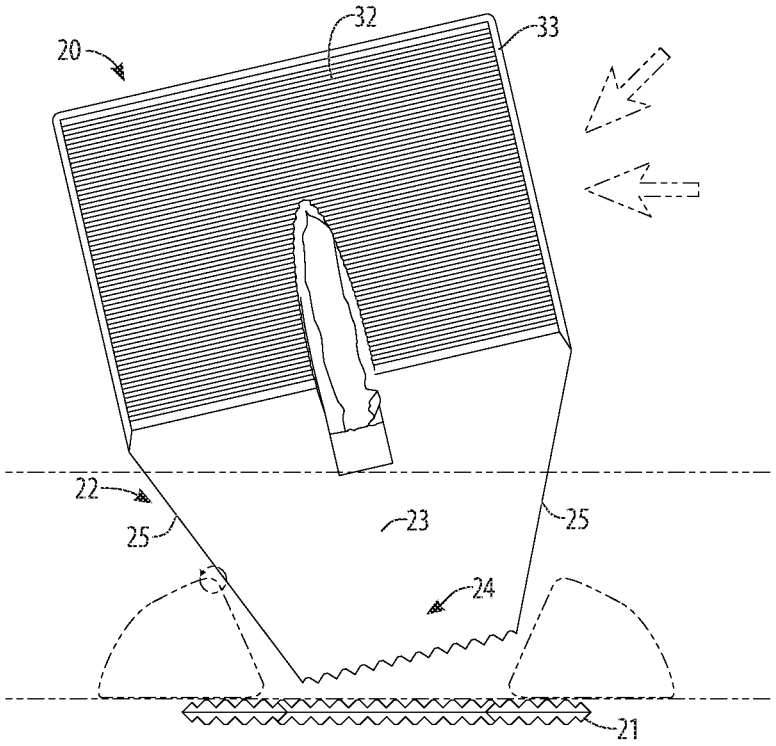
FIG. 12 is a front view of the straight-sided embodiment of the footed tab of the tile-setting lippage control system of the invention in use during removal from cured mortar.

Referring to FIG. 9 and FIG. 10, showing a curved-sided embodiment of the footed tab 20, and to FIG. 11 and FIG. 12, showing a straight-sided embodiment: after the mortar has set, mortar will have set up against the lower portion of the footed tab 20. Mortar encapsulation of the footplate 21 area is required by the ANSI standard. The footed tab 20 is removed by tearing the footed tab 20 away from the footplate 21, which remains under the installed tiles. Removal of the footed tab 20 is done by laterally striking the upper portion of the footed tab 20. The reinforced upper edge 33 provides strength and stability to withstand the striking force without deforming or collapsing, therefore transferring the force to the tapering base 24 joined to the footplate 21. Because the multi-tapered descending portion 22 of the footed tab 20 tapers down to join the footplate 21 along a line of smallest width and of smallest or thinnest depth or thickness, the force of the striking will separate or tear the footed tab 20 away from the mortar-embedded footplate 21 along that line. The reinforced upper edge 33 is substantially vertically straight at the sides of the footed tab 20, and will accommodate glancing or angled striking by transferring the force from such poorly-aimed strikes into the needed lateral force. The reinforced upper edge 33 is substantially horizontally straight at the top of the footed tab 20, and will transfer the force from striking without deforming or collapsing. The multi-tapered descending portion 22 of the system reduces the risk of damaging the installed tiles during removal of the footed tabs 20 by providing the thicker center 23 with thinning toward the edges, which restricts any tendency for pinching or binding or blocking to the small-area thicker center 23 which can deform sufficiently for removal. The tapering base 24 similarly avoids binding or blocking, and preferentially tears cleanly at its thinnest area where it joins the footplate 21. The shape of the tapering side 25 opposite the side being struck will promote a rotating or pivoting movement up and over the obstructing cured mortar, and the other tapering side 25 will pull away from the cured mortar without encountering any further binding or blocking.

During removal by lateral striking, the ridged upper portion 32 and reinforced upper edge 33 will resist being collapsed by the force of the strike, and will transfer the force to the multi-tapered descending portion 22. The straight top-to-bottom orientation of the reinforced upper edge 33 transfers force from an off-axis strike into a more effective direction.

The clean and simple removal of the footed tab 20 after the mortar has set, which does not leave residue in the grout joint requiring additional attention, greatly reduces the risk of damaging the installed tiles, which would require expensive remedial action by the installer in order to properly complete the installation job. The configuration of the footplate 21, with a double-forked footprint and large number of ridges, and with only a small thin line of tearing away from the tapering base 24, which is otherwise surrounded by mortar filling the former void spaces, allows and promotes the full encapsulation of the footplate 21 required by the ANSI standard, which in turn allows and promotes a solid and stable tile installation which will not develop problems over time.

Figure 13:
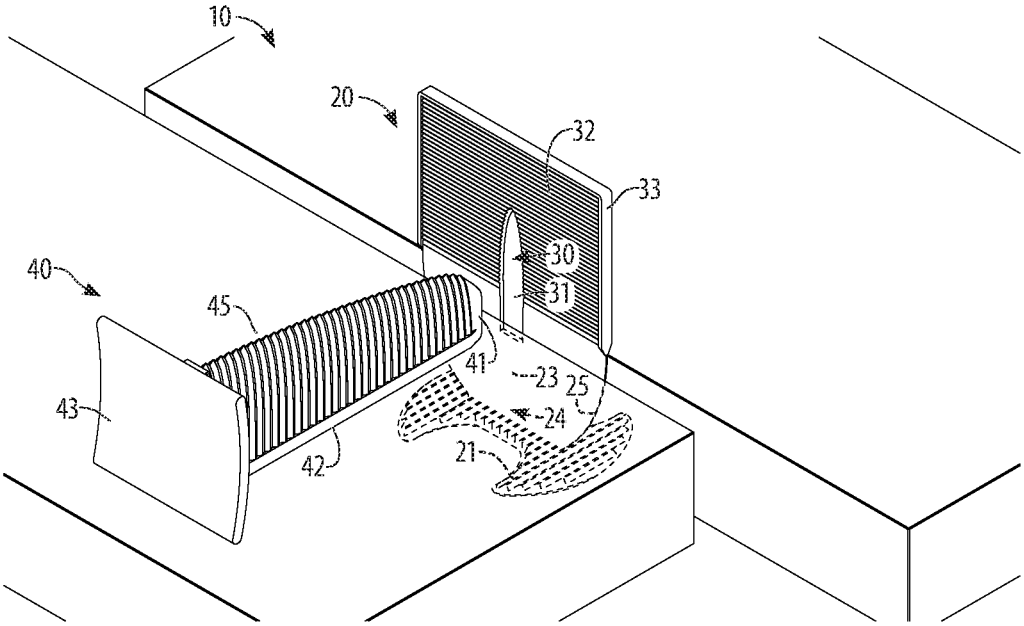
FIG. 13 is a perspective view of the tab-and-wedge pair of the tile-setting lippage control system in use prior to insertion of tensioning wedge.
Figure 14:
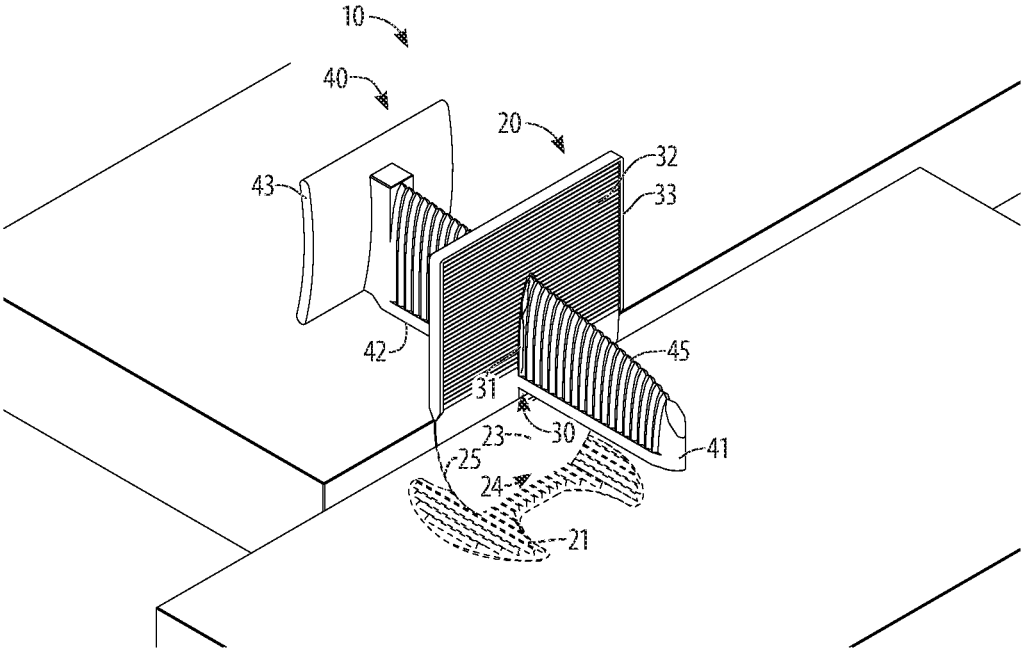
FIG. 14 is a perspective view of the tab-and-wedge pair of the tile-setting lippage control system in use after insertion of tensioning wedge.

Referring to FIG. 13 and FIG. 14, in use the footed tab 20 is placed along the joint area between two tiles, with the footplate 21 extending beneath both tiles, with the multi-tapered descending portion 22 extending upward through the grout joint, and with the ridged upper portion 32 extending upward above the surface of the tiles. The membrane 31 of the wedge slot 30 is intact. Mortar has been applied to the prepared surface underneath the tiles and the footplate 21, and that mortar has moved around the forks and through the ridges of the footplate 21, and into the lower portions of the void areas around the multi-tapered descending portion 22, encapsulating the footplate 21 and allowing and promoting a strong mortar bond between the tile bottoms and the prepared surface. The membrane 31 has prevented mortar from passing through the wedge slot 30 and possibly creating a bridge or plug of cured mortar which might interfere with removal.

The tensioning wedge 40 is then pushed into the wedge slot 30 of the footed tab 20. The leading end 41 breaks the membrane 31 at the level of the wedge bottom 42, which is the level of the top surface of the tiles. The tensioning wedge 40 is pushed into the wedge slot 30 until the tapering top surface of the tensioning wedge 40 is in contact with the ridged upper portion 32 at the top of the wedge slot 30 with the desired amount of compressive force exerted on the top of the tiles by the wedge bottom 42 and on the bottom of the tiles by the footplate 21. The wedge teeth 45 engage with the edge of the wedge slot 30 to toggle or lock the tensioning wedge 40 in place and a constant compressive force is placed against the tops and bottoms of both tiles. Because the upper portion of the tensioning wedge 40 and the wedge slot 30 have matching substantially ogive shapes, as treated above, force is distributed along all of the contacting surfaces, reducing any tendency for deformation, collapsing, or tearing of the materials.

The wedge bottom 42 of the tensioning wedge 40 is solid and rigid and straight, and holds the tops of the tiles in alignment with each other with no substantial give or play or deviation. The footplate 21 has a double-forked footprint with two separate forks supporting the bottom of each tile, and the footplate 21 is heavily ridged, which together allow more play or deviation allowing more conformation to variations in tile thickness at the bottoms of the tiles rather than at the tops. The tops of the two adjacent tiles are held even with each other while any variations in tile thickness are adjusted for at the bottoms, while ensuring that the tile bottoms, at the edges, are adequately and fully supported by mortar.

The tab-and-wedge pair 10 are left in place until the mortar has cured and set. The tab-and-wedge pair 10 can then be removed as treated above. The tensioning wedge 40 can be removed before the footed tab 20 is removed by striking, or the tensioning wedge 40 can be left in place, which is likely to happen occasionally no matter what instructions are given. The shape of the multi-tapered descending portion 22 of the footed tab 20 avoids any blocking, trapping, or obstruction of that portion by cured mortar which is required to completely encapsulate the footplate 21. As treated above, striking either of the sides of the reinforced upper edge 33 directly or at an angle will transfer force to the most narrow and thin portion of the footed tab 20 at the tapering base 24 where it joins the footplate 21, and the footed tab 20 will tear away from the footplate 21. Other than the footplate 21, no other portion of the footed tab 20 can be torn away from the main. Because the multi-tapered descending portion 22 of the footed tab 20 cannot be blocked or trapped by cured mortar, there will not be any need to dig or cut. The upper portion of the footed tab 20 will not damage the tile during removal because the material is not hard enough to do any damage. If the tensioning wedge 40 is still in place during attempted removal, the tensioning wedge 40 by itself will not damage the tile in the absence of excess downward force such as a direct downward strike or placement or passage of a heavy object or vehicle. The safer practice would be to remove the tensioning wedge 40 after curing and before removal of the top portion of the footed tab 20. Because the tensioning wedge 40 can be re-used, such a practice could also ensure that the tensioning wedges 40 are gathered and set aside for subsequent use.

After removal, the tensioning wedge 40 is not damaged and can be re-used in subsequent installations. The footed tab 20 is torn away from the footplate 21 during use, and therefore cannot be re-used for its original purpose. However, the removed upper portion of the footed tab 20 can be re-purposed for use as a spacer for subsequent installations. When used as a spacer, the multi-tapered descending portion 22 of the footed tab 20 will not become blocked or stuck by any cured mortar, and can always be easily removed.

Both the footed tab 20 and the tensioning wedge 40 can be made of recycled and recyclable plastic material. The tensioning wedge 40 can be re-used as a tensioning wedge in later installations because the wedge is not damaged during use and because the wedge can be used for installations of various thicknesses of tile. The footed tab 20 is designed to be torn in use, leaving the footplate 21 underneath the installed tiles, but the once-used footed tab 20 can be re-used as an easily removable spacer for later installations. The tab-and-wedge pair 10 are left in place until the mortar has cured and set. The tab-and-wedge pair 10 can then be removed as treated above. The tensioning wedge 40 can be removed before the footed tab 20 is removed by striking, or the tensioning wedge 40 can be left in place, which is likely to happen occasionally no matter what instructions are given. After removal, the tensioning wedge 40 is not damaged and can be re-used in subsequent installations. The footed tab 20 is torn away from the footplate 21 during use, and therefore cannot be re-used for its original purpose. However, the removed upper portion of the footed tab 20 can be re-purposed for use as a spacer or a wedge for subsequent installations. When used as a spacer, the multi-tapered descending portion 22 of the footed tab 20 will not become blocked or stuck by any cured mortar, and can always be easily removed.

Figure 15:
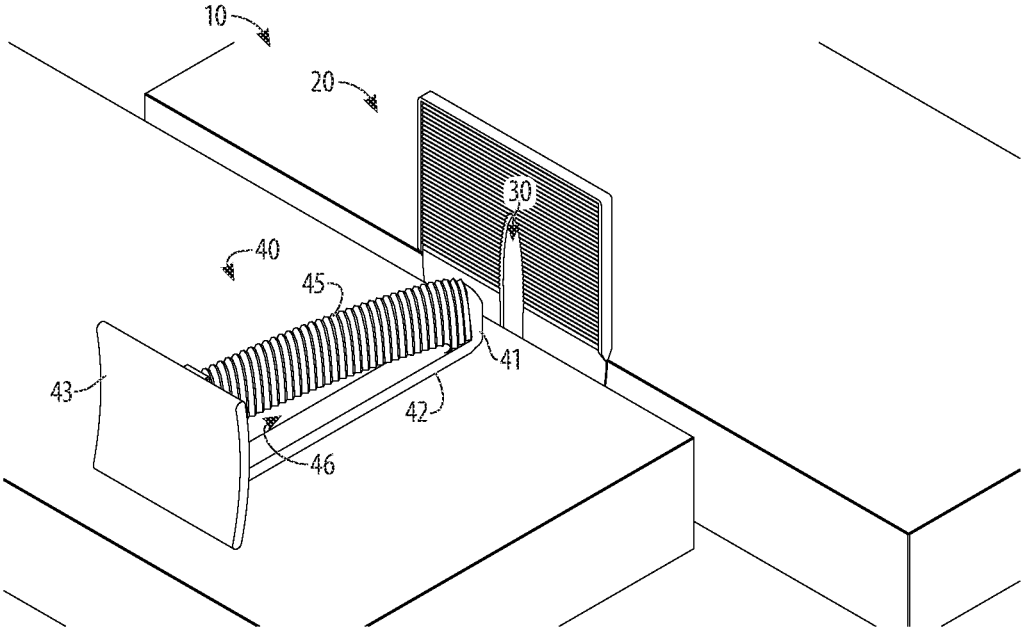
FIG. 15 is a perspective view of the tab-and-wedge pair of an embodiment of the tile-setting lippage control system having a wedge void in use prior to insertion of tensioning wedge.
Figure 16:
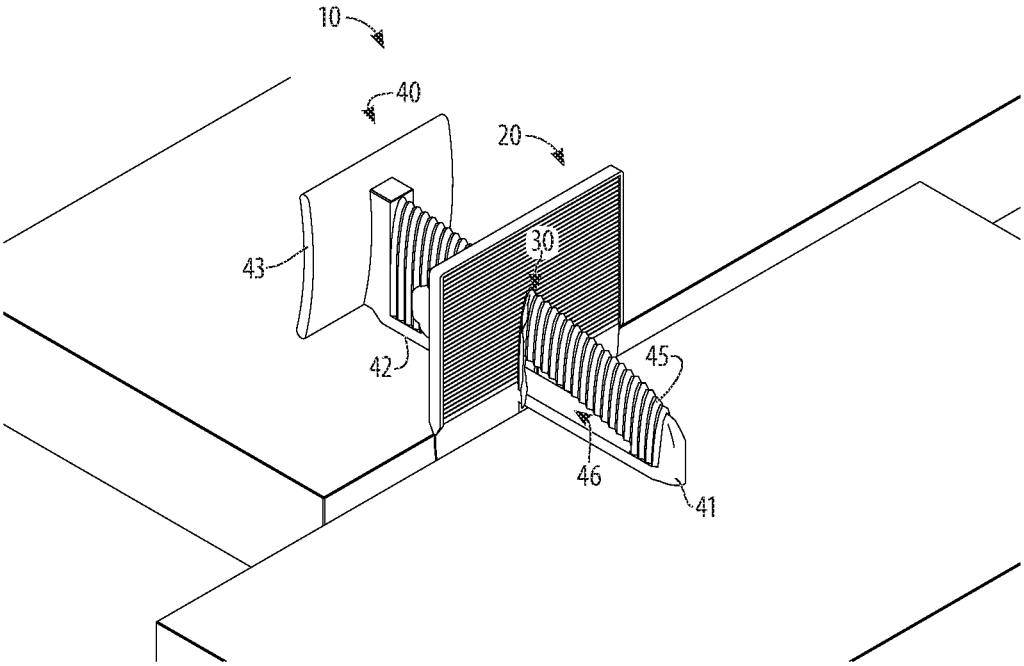
FIG. 16 is a perspective view of the tab-and-wedge pair of an embodiment of the tile-setting lippage control system having a wedge void in use after insertion of tensioning wedge.

During installation, after the tensioning wedge 40 is inserted and while the mortar is curing, the tab-and-wedge pair 10 might be bumped or kicked inadvertently. A very strong or sharp bumping or kicking would likely prematurely tear the footed tab 20 from the footplate 21, but would not damage the tile. A less-strong or less-sharp bumping or kicking could cause the tensioning wedge 40 to exert excessive force on the wedge slot 30 in the ridged upper portion 32 of the footed tab 20. The ridges of the ridged upper portion 32, along with the reinforced upper edge 33, provide more lateral strength and less vertical strength, and the ridged upper portion 32 should deform slightly to absorb the excess force, again without damaging the tile Referring to FIG. 15 and FIG. 16, an embodiment of the tensioning wedge 40 of the tile-setting lippage control system 10 provides a wedge void 46. In use, during insertion of the tensioning wedge 40, the wedge void 46 allows the tensioning wedge 40 to deform slightly, which can make insertion easier. After insertion, the tensioning wedge 40 will exert a force resisting the deformation, providing a constant upward force against the wedge slot 30, and the force is transferred to the footplate 21, during use during the setting of the mortar. The tensioning wedge 40 with the wedge void 46 can also absorb or buffer sharp forces from bumping or kicking the tensioning wedge 40 by deforming to absorb the force or spread out the duration of the sharp force.

Figure 17:
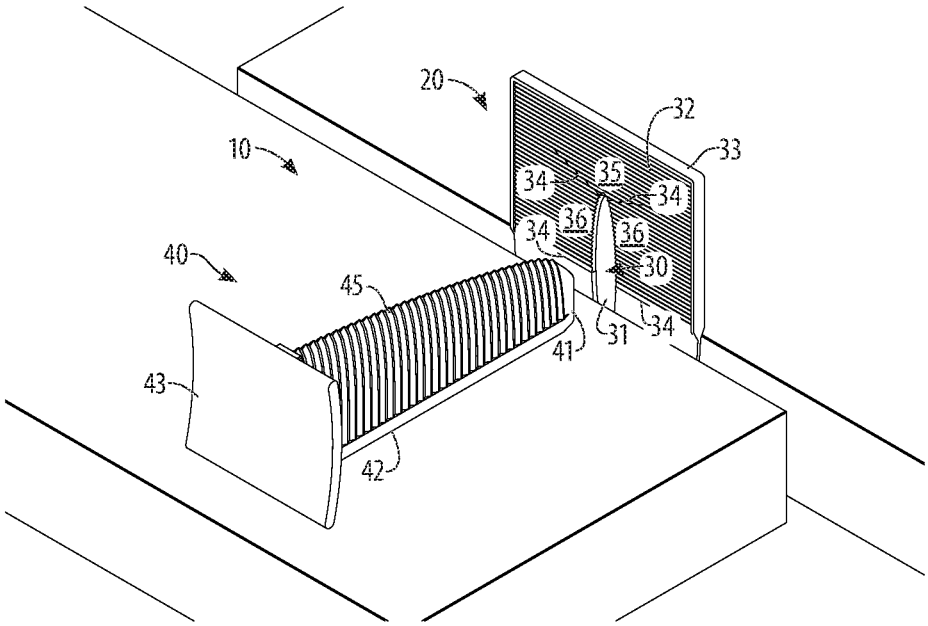
FIG. 17 is a perspective view of the tab-and-wedge pair of an embodiment of the tile-setting lippage control system having flap cuts in use prior to insertion of tensioning wedge.
Figure 18:
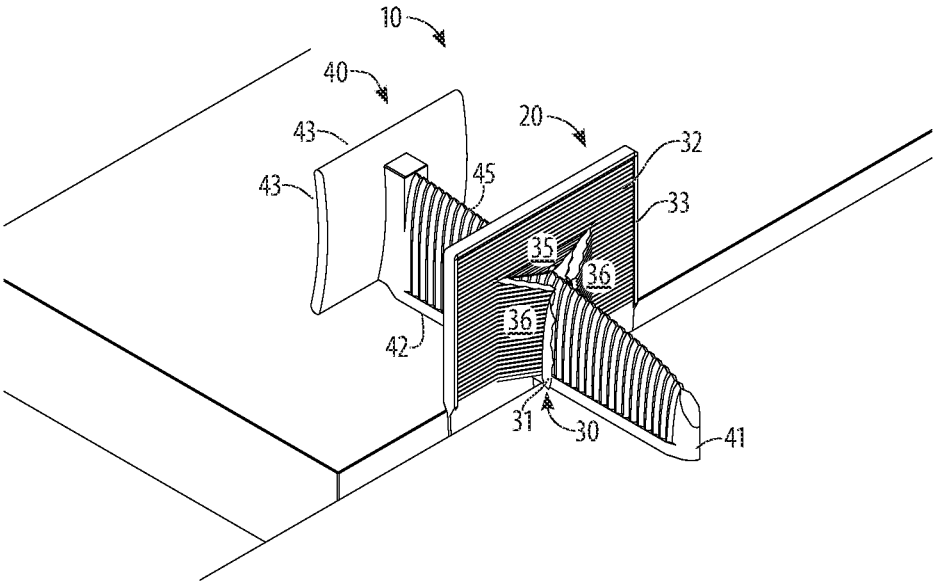
FIG. 18 is a perspective view of the tab-and-wedge pair of an embodiment of the tile-setting lippage control system having flap cuts in use after insertion of tensioning wedge.

Referring to FIG. 17 and FIG. 18, in an embodiment having flap cuts 34, as the tensioning wedge 40 is pushed through the ridged upper portion 32 of the footed tab 20 the flap cuts 34 allow the deformation of areas forming a top flap 35 and side flaps 36. The wedge teeth 45 of the tensioning wedge 40 engage with and lock or toggle against the top flap 35 and side flaps 36. The top flap 35 and side flaps 36 provide additional ability to absorb or buffer excess force from over-insertion of the tensioning wedge 40 from careless installation or from bumping or kicking. The top flap 35 and side flaps 36 also lock the tensioning wedge 40 more securely in position during curing of the mortar because sufficient backward force must be applied to cause the flaps 35, 36 to toggle to the opposite direction. This additional locking action can help prevent the tensioning wedge 40 from being inadvertently pulled or knocked backward or out of the wedge slot 30.

Many other changes and modifications can be made in the system and method of the present invention without departing from the spirit thereof. We therefore pray that our rights to the present invention be limited only by the scope of the appended claims.

We claim:

1. A tile-setting lippage control system for use with tiles set with mortar as floors or walls on prepared surfaces, the tile-setting lippage control system comprising:

(i) a footed tab having a top-to-bottom orientation in relation to the tiles, a side-to-side width along the tile edges, and tab faces substantially parallel to tile edges;

(ii) a tensioning wedge having a long axis defining a direction of travel perpendicular to tile edges in use, a straight wedge bottom adapted to apply compressive force to the top of the tile in use, an upper surface with tapering height from lesser at a leading end to greater at a wide trailing end, and having wedge teeth;

(iii) a footplate mounted at the bottom of said footed tab, adapted to allow encapsulation with mortar in use, and adapted to apply compressive force to the bottom of tile in use;

(iv) a multi-tapered descending portion at the bottom of said footed tab having on each tab face a thicker center tapering toward the sides, a tapering base thinning toward said footplate, and tapering sides of reducing width toward the bottom;

(v) a wedge slot passing through the central portion of said footed tab, having a membrane initially blocking passage through said wedge slot, adapted to allow placement of said tensioning wedge through said wedge slot such that contact of said wedge bottom with the top of tiles of various thicknesses will cause different portions of the upper surface of said tensioning wedge to contact the edges of said wedge slot, and breaking said membrane at substantially the level of said wedge bottom;

(vi) a ridged upper portion of said footed tab having a reinforced upper edge having substantially vertical sides, adapted to withstand and transfer force applied in use to remove said footed tab after setting of the mortar; and (vii) flap cuts in said ridged upper portion adapted to form a top flap and side flaps as said tensioning wedge is pushed through said wedge slot, with said top flap making locking engagement with said top teeth and said side flaps making locking engagement with said side teeth.

2. The tile-setting lippage control system of claim 1, where said tensioning wedge further comprises a wedge void.

3. The tile-setting lippage control system of claim 1, where said tapering sides taper in a curve.

4. The tile-setting lippage control system of claim 1, where said tapering sides taper in a straight line.

5. The tile-setting lippage control system of claim 1, where said footed tab is made of a recyclable plastic material.

6. The tile-setting lippage control system of claim 1, where said footed tab is made of high-density polyethelene.

7. The tile-setting lippage control system of claim 1, where said tensioning wedge is made of a recyclable plastic material.

8. The tile-setting lippage control system of claim 1, where said tensioning wedge is made of high-density polyethelene.

9. The tile-setting lippage control system of claim 1, where said footplate further comprises a double-forked footprint.

10. The tile-setting lippage control system of claim 1, where said footplate further comprises ridges.

11. The tile-setting lippage control system of claim 1, where said footplate is further adapted to adjust for variations in tile thickness at the bottom of the tiles.

12. The tile-setting lippage control system of claim 1, further adapted for re-use of said tensioning wedge in later tile installations.

13. The tile-setting lippage control system of claim 1, further adapted for re-use of said footed tab as a tile spacer.

14. A tile-setting lippage control method comprising:

(i) providing a tile-setting lippage control system comprising:

(a) a footed tab having a top-to-bottom orientation in relation to the tiles, a side-to-side width along the tile edges, and tab faces substantially parallel to tile edges;

(b) a tensioning wedge having a long axis defining a direction of travel perpendicular to tile edges in use, a straight wedge bottom adapted to apply compressive force to the top of the tile in use, an upper surface with tapering height from lesser at a leading end to greater at a wide trailing end, and having wedge teeth;

(c) a footplate mounted at the bottom of said footed tab, adapted to allow encapsulation with mortar in use, and adapted to apply compressive force to the bottom of tile in use;

(d) a multi-tapered descending portion at the bottom of said footed tab having on each tab face a thicker center tapering toward the sides, a tapering base thinning toward said footplate, and tapering sides of reducing width toward the bottom;

(e) a wedge slot passing through the central portion of said footed tab, having a membrane initially blocking passage through said wedge slot, adapted to allow placement of said tensioning wedge through said wedge slot such that contact of said wedge bottom with the top of tiles of various thicknesses will cause different portions of the upper surface of said tensioning wedge to contact the edges of said wedge slot, and breaking said membrane at substantially the level of said wedge bottom;

(f) a ridged upper portion of said footed tab having a reinforced upper edge having substantially vertical sides, adapted to withstand and transfer force applied in use to remove said footed tab after setting of the mortar; and (g) flap cuts in said ridged upper portion adapted to form a top flap and side flaps as said tensioning wedge is pushed through said wedge slot, with said top flap making locking engagement with said top teeth and said side flaps making locking engagement with said side teeth;

(ii) applying mortar to the prepared surface;

(iii) placing said footed tab between two adjacent tiles, with said footplate underneath both tiles, and with said multi-tapered descending portion extending upward through the grout joint;

(iv) pushing said tensioning wedge through said wedge slot until compressive force is placed on both tiles between said wedge bottom and said footplate;

(v) allowing curing and setting of the mortar;

(vi) removing said footed tab from the grout joint by lateral striking of said reinforced upper edge;

(vii) leaving said footplate under the tiles, encapsulated in mortar; and (viii) grouting the grout joint.

* * * * *